US009159227B2

(12) United States Patent
Sato

(10) Patent No.: US 9,159,227 B2
(45) Date of Patent: Oct. 13, 2015

(54) TRAFFIC CONGESTION DETECTION APPARATUS AND VEHICLE CONTROL APPARATUS

(75) Inventor: Kunihito Sato, Mishima (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 5 days.

(21) Appl. No.: 13/983,478

(22) PCT Filed: Feb. 3, 2012

(86) PCT No.: PCT/IB2012/000181

§ 371 (c)(1),
(2), (4) Date: Aug. 2, 2013

(87) PCT Pub. No.: WO2012/104720

PCT Pub. Date: Aug. 9, 2012

(65) Prior Publication Data

US 2013/0325284 A1 Dec. 5, 2013

(30) Foreign Application Priority Data

Feb. 3, 2011 (JP) ..... 2011-022019

(51) Int. Cl.

| | |
|---|---|
| ***G08G 1/00*** | (2006.01) |
| ***G08G 1/01*** | (2006.01) |
| ***G08G 1/0967*** | (2006.01) |

(52) U.S. Cl.

CPC ..... *G08G 1/00* (2013.01); *G08G 1/0104* (2013.01); *G08G 1/0112* (2013.01); *G08G 1/0133* (2013.01); *G08G 1/0145* (2013.01); *G08G 1/09675* (2013.01); *G08G 1/096725* (2013.01);

(Continued)

(58) Field of Classification Search

CPC ..... G08G 1/00; G08G 1/0122; G08G 1/0133; G08G 1/0145; G08G 1/0104; G08G 1/09675; G08G 1/096725; G08G 1/096775; G08G 1/096791

USPC ..... 701/93, 96

See application file for complete search history.

(56) References Cited

U.S. PATENT DOCUMENTS

| | | | | |
|---|---|---|---|---|
| 6,292,737 | B1 * | 9/2001 | Higashimata et al. | 701/96 |
| 2002/0045985 | A1 * | 4/2002 | Kerner | 701/117 |
| 2002/0062189 | A1 * | 5/2002 | Kannonji | 701/96 |

(Continued)

FOREIGN PATENT DOCUMENTS

| | | |
|---|---|---|
| EP | 1 176 569 | 1/2002 |
| EP | 2 180 456 | 4/2010 |

(Continued)

OTHER PUBLICATIONS

International Search Report Issued May 31, 2012 in PCT/IB12/000181 Filed Feb. 3, 2012.

*Primary Examiner* — Y. Beaulieu
*Assistant Examiner* — Thomas Ingram
(74) *Attorney, Agent, or Firm* — Oblon, McClelland, Maier & Neustadt, L.L.P.

(57) ABSTRACT

A traffic congestion detection apparatus includes a traveling information acquisition unit for acquiring traveling information relating to a traveling state of a vehicle, and a traveling zone determination unit for determining which one of at least three zones including a central zone of a congestion area the vehicle is traveling in, based on current traveling information acquired by the traveling information acquisition unit.

10 Claims, 8 Drawing Sheets

(52) U.S. Cl.
CPC .... *G08G 1/096775* (2013.01); *G08G 1/096791* (2013.01)

(56) References Cited

U.S. PATENT DOCUMENTS

| | | | | |
|---|---|---|---|---|
| 2004/0260455 | A1* | 12/2004 | Dort | 701/117 |
| 2005/0137783 | A1* | 6/2005 | Dort | 701/119 |
| 2010/0138141 | A1* | 6/2010 | Hayashida et al. | 701/118 |
| 2010/0256852 | A1* | 10/2010 | Mudalige | 701/24 |
| 2014/0236449 | A1* | 8/2014 | Horn | 701/96 |

FOREIGN PATENT DOCUMENTS

| | | |
|---|---|---|
| JP | 2000 067396 | 3/2000 |
| JP | 2004 233191 | 8/2004 |
| JP | 2005 165388 | 6/2005 |
| JP | 2005 324661 | 11/2005 |
| JP | 2008 281448 | 11/2008 |
| JP | 2009 123153 | 6/2009 |
| JP | 2010 102575 | 5/2010 |

* cited by examiner

TRAFFIC CONGESTION DETECTION APPARATUS AND VEHICLE CONTROL APPARATUS

BACKGROUND OF THE INVENTION

1. Field of the Invention

The invention relates to a traffic congestion detection apparatus, and a vehicle control apparatus.

2. Description of Related Art

A vehicle control apparatus is available which is designed to determine traffic congestion based on a traffic report or a traveling pattern of a vehicle and to cause the vehicle to travel according to a result of the determination. For example, Japanese Patent Application Publication No. 2005-324661 (JP-A-2605-324661) describes a vehicle control apparatus which is designed such that a length of traffic congestion is calculated based on traffic congestion information or a traveling pattern of a vehicle and the vehicle is operated automatically when the length of traffic congestion is not less than a predetermined value.

However, the vehicle control apparatus described in JP-A-2005-324661 is not able to achieve a high accuracy in determination of traffic congestion due to delayed traffic report or erroneous determination of the traveling pattern. Further, the vehicle control apparatus described in JP-A-2005-324661, which determines whether or not automatic operation of the vehicle is to be performed based on a length of traffic congestion, is not able to adapt to various traveling states of the vehicle in the traffic congestion.

SUMMARY OF THE INVENTION

The invention provides a traffic congestion detection apparatus and a vehicle control apparatus which make it possible to determine a traveling state of a vehicle in traffic congestion with high accuracy, and to control traveling of the vehicle according to the traveling state of the vehicle in the traffic congestion.

A traffic congestion detection apparatus according to a first aspect of the invention includes: traveling information acquisition means for acquiring traveling information relating to a traveling state of a vehicle; and traveling zone determination means for determining which one of at least three zones including a central zone of a congestion area the vehicle is traveling in, based on current traveling information acquired by the traveling information acquisition means.

In the first aspect of the invention, it has been found that a congestion area can be classified into at least three zones based on a traveling state of a vehicle. According to the aspect, it can be determined which one of the at least three zones the vehicle is traveling in based on the current traveling information, whereby it can be estimated what kind of traveling state the vehicle is in based on the zone determined to be the zone where the vehicle is traveling. Further, it is also made possible to perform control according to a traveling zone of the congestion area, for example, by performing adequate driving assist according to the traveling zone of the congestion area. As a result, the fuel consumption of the vehicle can be reduced.

The traffic congestion detection apparatus according to the first aspect of the invention may be configured such that the traveling information acquisition means acquires traveling information from a plurality of vehicles, and the traveling zone determination means determines which zone of the congestion area the vehicle is traveling in, based on the traveling information of the plurality of vehicles acquired by the traveling information acquisition means and current traveling information of the vehicle. This configuration makes it possible to determine the traveling zone of the vehicle based on traveling information of a plurality of vehicles, resulting in more accurate determination.

The traffic congestion detection apparatus according to the first aspect of the invention may further include traveling information analysis means for analyzing a plurality of items of traveling information acquired by the traveling information acquisition means and classifying the plurality of items of traveling information into the at least three zones. According to this configuration, a plurality of items of traveling information are classified into three zones based on the plurality of items of traveling information, whereby the accuracy of the classification can be improved, and it can be determined more accurately which zone of the congestion area the vehicle is traveling in.

The traffic congestion detection apparatus according to the first aspect of the invention may be configured such that the traveling information analysis means classifies a plurality of items of traveling information into at least three zones by performing multivariate analysis on vehicle speeds. According to this configuration, the accuracy of the classification can be improved by the multivariate analysis of the vehicle speeds, and the determination can be made more accurately which zone of the congestion area the vehicle is traveling in.

The traffic congestion detection apparatus according to the first aspect of the invention may be configured such that the traveling information analysis means analyzes the plurality of items of traveling information acquired by the traveling information acquisition means and sets the at least three zones according to a change in the traveling state.

The traffic congestion detection apparatus according to the first aspect of the invention may further include input means for performing setting for the traffic congestion detection apparatus, and the at least three zones are set by means of the input means.

The traffic congestion detection apparatus according to the first aspect of the invention may be configured such that the traveling zone determination means determines which one of a tail zone, the central zone, and a restoration zone of the congestion area the vehicle is traveling in. According to this configuration, the congestion area is classified into a tail zone, the central zone, and a restoration zone, whereby adequate control can be performed for each zone, for example, by performing adequate driving assist according to a behavior (traveling state) of the vehicle in each zone. As a result, the fuel consumption of the vehicle can be reduced even more.

A vehicle control apparatus according to a second aspect of the invention includes a traffic congestion detection apparatus according to the first aspect and driving assist means for performing driving assist for a vehicle according to a result of determination by the traveling zone determination means. This configuration makes it possible to perform adequate driving assist according to each traveling zone of the congestion area. As a result, the fuel consumption of the vehicle can be reduced even more.

A vehicle control apparatus according to a third aspect of the invention may further include: a traffic congestion detection apparatus according to the first aspect; driving assist means for assisting driving of the vehicle based on a result of the determination by the traveling zone determination means; other vehicle information acquisition means for acquiring traveling information relating to a traveling state of another vehicle; and other vehicle traveling zone determination means for determining whether or not the other vehicle is traveling in the congestion area based on the traveling information of the other vehicle acquired by the other vehicle information acquisition means and a result of the analysis by the traveling information analysis means. The driving assist means may perform driving assist for the vehicle based on a result of the determination by the other vehicle traveling zone determination means. This configuration makes it possible to perform adequate driving assist according to whether or not the other vehicle is traveling in the congestion area. As a result, the fuel consumption of the vehicle can be reduced even more.

The vehicle control apparatus according to the third aspect of the invention may be configured such that the traveling information analysis means analyzes a plurality of items of traveling information acquired by the traveling information acquisition means and sets the at least three zones according to a change in the traveling state.

The vehicle control apparatus according to the third aspect of the invention may further include input means for performing setting for the traffic congestion detection apparatus, and the at least three zones may be set by means of the input means.

The vehicle control apparatus according to the third aspect of the invention may be configured such that the driving assist means sets a recommended speed for each of the at least three zones and performs acceleration/deceleration control in a predetermined range the center of which is set to the recommended speed.

The vehicle control apparatus according to the third aspect of the invention may be configured such that the traveling zone determination means determines which one of a tail zone, the central zone, and a restoration zone of the congestion area the vehicle is traveling in.

The vehicle control apparatus according to the third aspect of the invention may be configured such that when the vehicle is traveling in the tail zone, the driving assist means sets a target inter-vehicle distance to be greater than a target inter-vehicle distance during normal traveling of the vehicle that is traveling outside of the congestion area; and when the vehicle is traveling in the restoration zone, the driving assist means sets a target inter-vehicle distance to be smaller than a target inter-vehicle distance during normal traveling of the vehicle that is traveling outside of the congestion area.

According to the third aspect of the invention, the traveling state of the vehicle in a congestion area can be determined with high accuracy.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
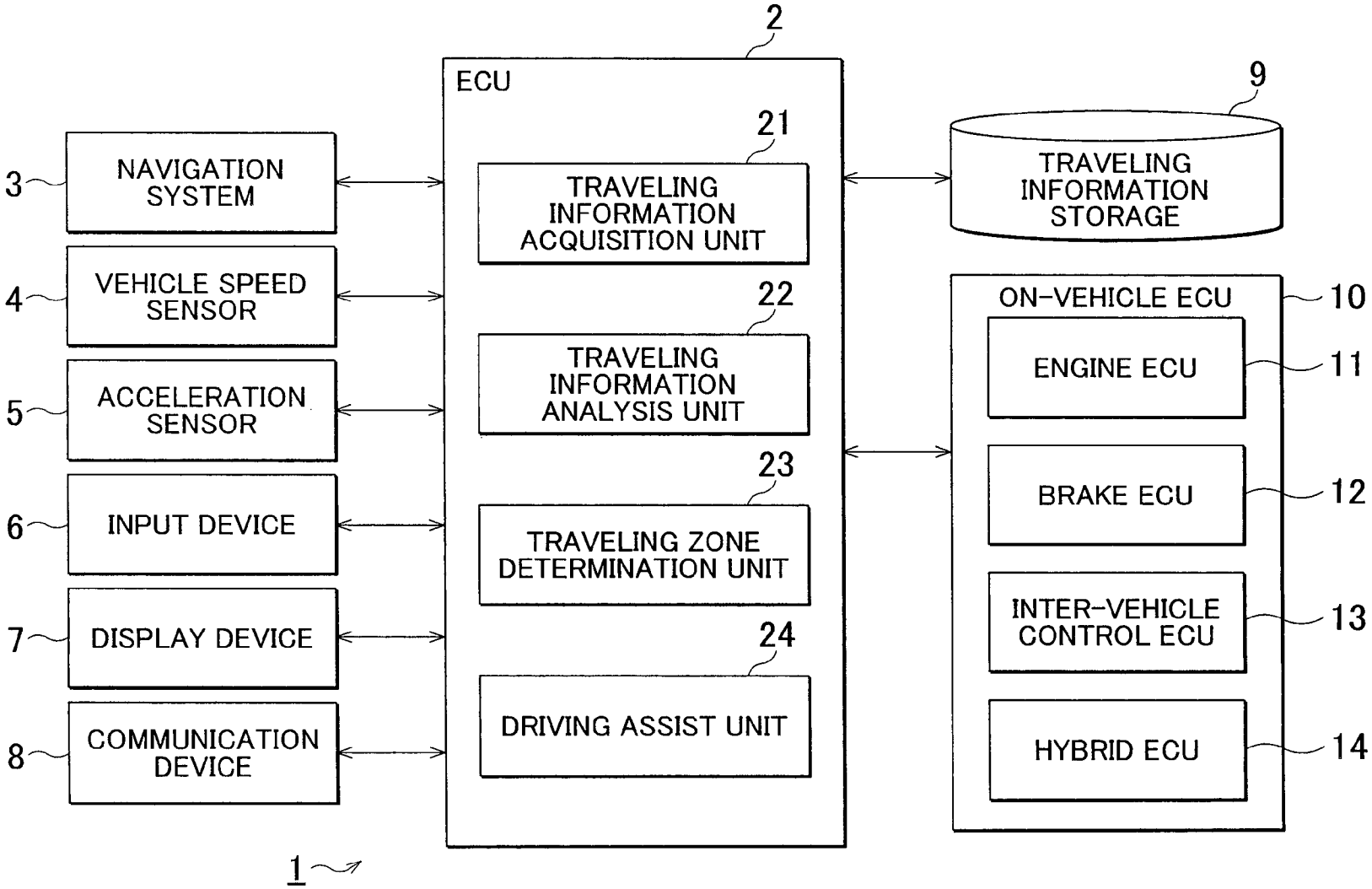
FIG. 1 is a schematic configuration diagram of a traffic congestion detection apparatus according to an embodiment of the invention.

An embodiment of the invention will be described in detail with reference to the accompanying drawings. In the drawings, the same components are assigned with the same reference numerals, and redundant description thereof will be omitted.

FIG. 1 is a schematic configuration diagram illustrating a traffic congestion detection apparatus 1 according to the embodiment. The traffic congestion detection apparatus 1 is an apparatus which is mounted on a host vehicle and determines a traveling zone where the host vehicle is traveling. As shown in FIG. 1, the traffic congestion detection apparatus 1 includes an electronic control unit (ECU) 2, a navigation system 3, a vehicle speed sensor 4, an acceleration sensor 5, an input device 6, a display device 7, a communication device 8, a traveling information storage 9, and an on-vehicle ECU 10.

The ECU 2 is mainly composed of a computer including a central processing unit (CPU), a read only memory (ROM), a random access memory (RAM), an I/O interface and so on. The ECU 2 is connected to the navigation system 3, the vehicle speed sensor 4, the acceleration sensor 5, the input device 6, the display device 7, the communication device 8, the riving information storage unit 9, and the on-vehicle ECU 10. The ECU 2 includes a traveling information acquisition unit 21, a traveling information analysis unit 22, and a traveling zone determination unit 23. The ECU 2 may further include a driving assist unit 24. In this case, the traffic congestion detection apparatus 1 functions as a vehicle control apparatus for performing control according to a traveling zone where the host vehicle is traveling.

The navigation system 3 has a global positioning system (GPS) receiver (not shown) for acquiring a current traveling position of the host vehicle, and a map information database (not shown) for storing map information. The navigation system 3 calculates a route to an input destination based on the map information stored in the map information database, and provides route guidance by means of the display device 7 and/or a speaker (not shown). The navigation system 3 transmits to the ECU 2 traveling position information relating to a position where the host vehicle is currently traveling, and map information of an area around the traveling position of the host vehicle. The navigation system 3 stores, in the map information database, traffic congestion area information indicating an area where sag congestion frequently occurs.

The vehicle speed sensor 4 is provided, for example, in a wheel portion of the host vehicle. The vehicle speed sensor 4 detects a rotation speed of the wheels, and calculates a vehicle speed based on the detected wheel rotation speed. The vehicle speed sensor 4 transmits vehicle speed information based on the calculated vehicle speed to the ECU 2. The acceleration sensor 5 is provided, for example, in a front part of the host vehicle and detects longitudinal acceleration and lateral acceleration of the host vehicle. The acceleration sensor 5 transmits acceleration information based on the longitudinal and lateral accelerations to the ECU 2.

The input device 6 is a device which is used by a driver to perform various settings and various selections for traffic congestion detection apparatus 1. The input device 6 used in the embodiment is a control panel. The input device 6 may instead be a remote controller, or a touch panel using a display.

The display device 7 is a device for visually providing a user with information, and displays information such as route guidance information and various setting information. Although the display device 7 used in the embodiment is a liquid crystal display, another display device may be used. The display device 7 may be used in combination with an audio output unit such as a speaker.

The communication device 8 is a device for performing two-way communication with a roadside device or a base station provided on a major road or the like. The communication device 8 acquires traveling information including, for example, traveling position information or vehicle speed information of another vehicle through two-way communication with the roadside device or the base station. The communication device 8 transmits the traveling information of the other vehicle acquired from the roadside device or the base station to the ECU 2.

The traveling information storage 9 is storage means for storing traveling information which includes vehicle speed information received from the vehicle speed sensor 4 in an area zone indicated by the traffic congestion area information and time information indicating a time of day at which the vehicle speed information is received. The traveling information is stored together with the traffic congestion area information. The traveling information storage 9 is formed by a random access storage medium such as a hard disc, a flush memory, and a RAM. The traveling information storage 9 may be formed by a random access storage medium such as a RAM incorporated in the ECU 2.

The on-vehicle ECU 10 is an ECU which mounted on the host vehicle in addition to the ECU 2. The on-vehicle ECU 10 includes, for example, an engine ECU 11, a brake ECU 12, an inter-vehicle control ECU 13, and a hybrid ECU 14. The engine ECU 11 is an ECU for controlling an engine. The engine ECU 11 controls the engine based on control information including acceleration/deceleration information transmitted from the ECU 2. The brake ECU 12 is an ECU for controlling a brake. The brake ECU 12 controls the brake based on control information including acceleration/deceleration information transmitted from the ECU 2.

The inter-vehicle control ECU 13 is an ECU for performing control according to a distance from another object such as the vehicle in front. The inter-vehicle control ECU 13 controls an inter-vehicle distance from the vehicle in front based on inter-vehicle control information transmitted from the ECU 2. The hybrid ECU 14 is an ECU for controlling a hybrid system. The hybrid ECU 14 controls the hybrid system based on control information transmitted from the ECU 2. Each of the engine ECU 11, the brake ECU 12, the inter-vehicle control ECU 13, and the hybrid ECU 14 is mainly formed by a computer including a CPU, a ROM, a RAM, an input/output (I/O) interface and the like.

Figure 2:
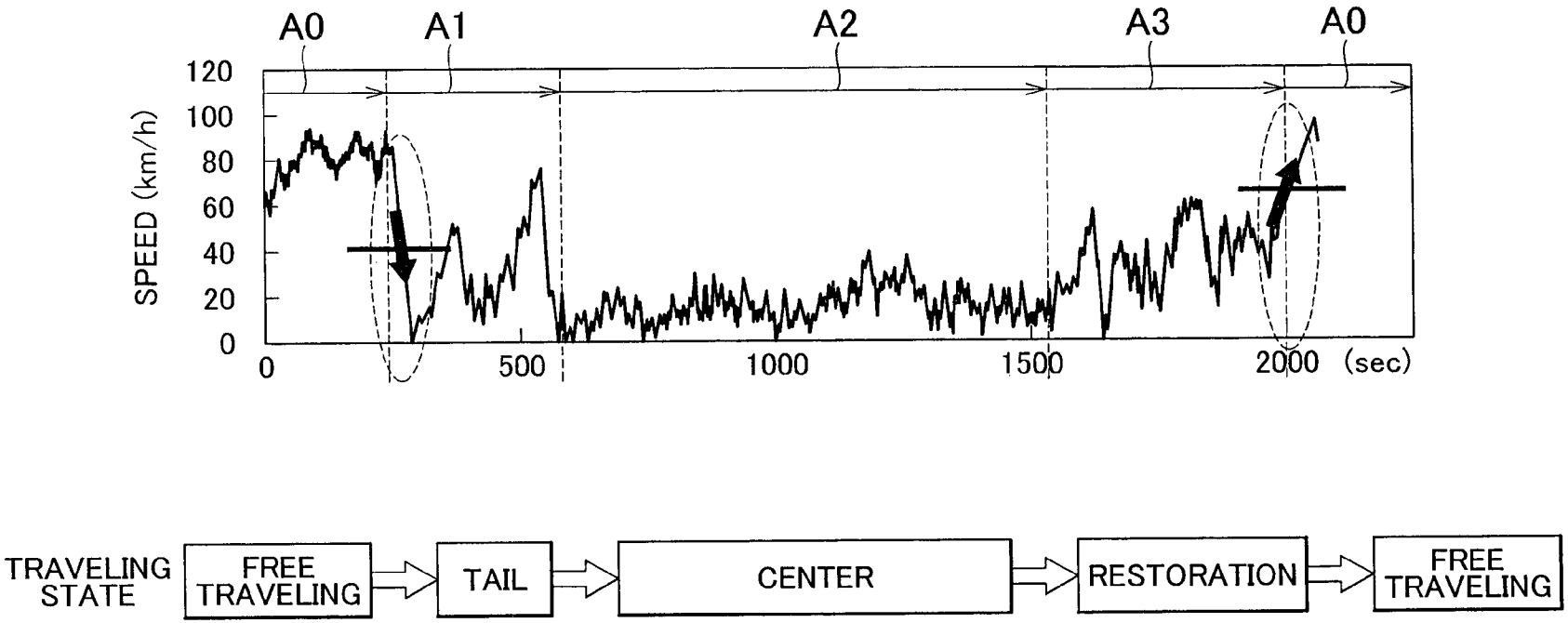
FIG. 2 is a diagram illustrating a relationship between elapsed time and vehicle speed in a congestion area.

FIG. 2 is a diagram illustrating a relation between vehicle speed and period of time required for a vehicle entering a congestion area to get out of the congestion area. A zone A0 is a free traveling zone where the vehicle is able to travel freely. A zone A1 is a zone where the vehicle exhibits a tendency to decelerate, and corresponds to a tail zone where the vehicle has just entered the congestion area. A zone A2 is a zone where the vehicle exhibits stable speed variation, and corresponds to a central zone of the congestion area. A zone A3 is a zone where the vehicle exhibits a tendency to accelerate, and corresponds to a restoration zone where the vehicle is about to get out of the congestion area. In this manner, the traffic congestion detection apparatus 1 according to the embodiment classifies the congestion area into a plurality of zones according to a behavior (traveling state) of the vehicle such as a change in vehicle speed.

Returning to FIG. 1, functions of the ECU 2 according to the embodiment will be described.

The traveling information acquisition unit 21 functions as traveling information acquisition means for acquiring traveling information on a traveling state of the vehicle. The traveling information acquisition unit 21 acquires traffic congestion area information from the navigation system 3. When the host vehicle travels in the area indicated by the acquired traffic congestion area information, the traveling information acquisition unit 21 stores, in the traveling information storage 9, traveling information including vehicle speed information received from the vehicle speed sensor 4 in this area and time information indicating a time of day at which the vehicle speed information is received, together with the traffic congestion area information.

Figure 3:
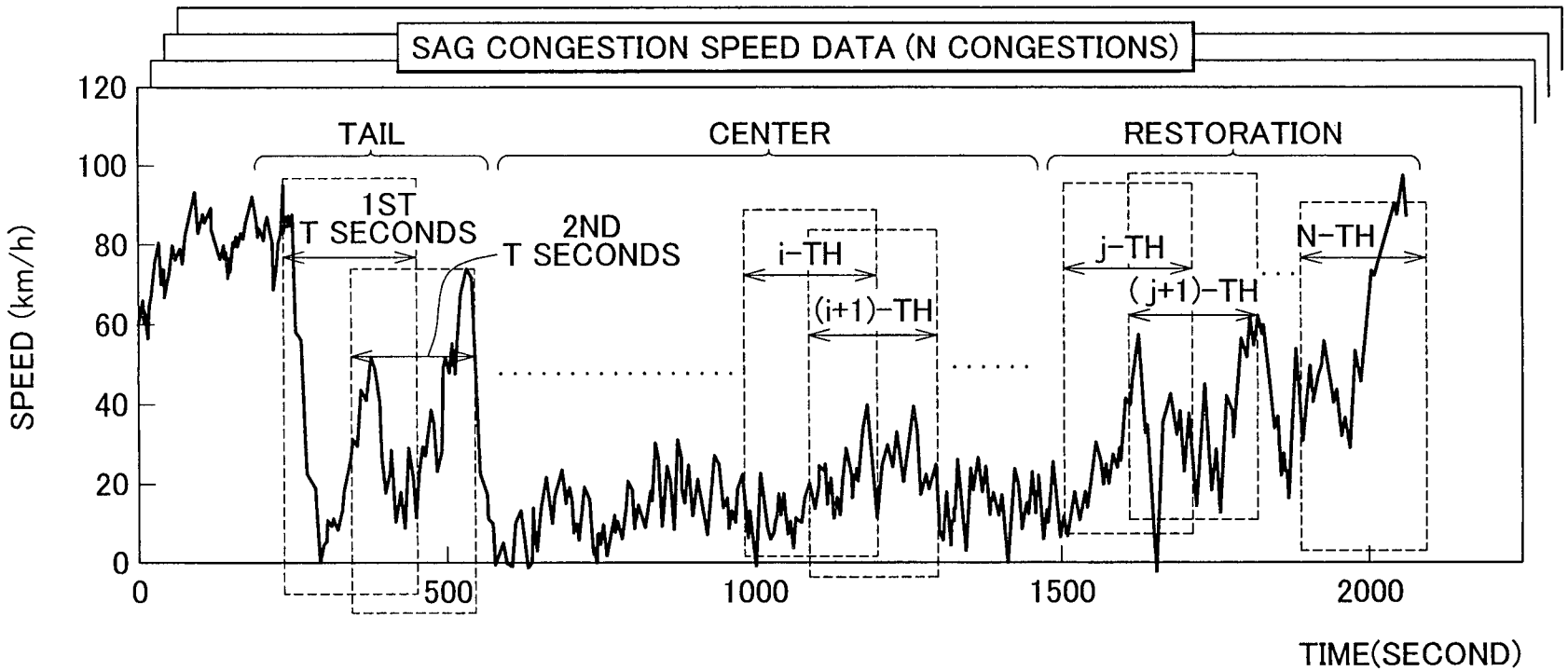
FIG. 3 is a diagram illustrating traveling information provided by the traffic congestion detection apparatus according to the embodiment of the invention during sag congestion.

The traveling information analysis unit 22 functions as traveling information analysis means for analyzing a plurality of items of traveling information acquired from the traveling information acquisition unit 21. Once the input device 6 is operated by the driver and information specifying an area where sag congestion often occurs (traffic congestion area) is received, the traveling information analysis unit 22 retrieves from the traveling information storage 9 a plurality of items of traveling information corresponding to this traffic congestion area. FIG. 3 is a diagram illustrating traveling information when sag congestion has occurred N times. As shown in FIG. 3, the traveling information analysis unit 22 displays the traveling information of the N sag congestions on the display device 7 as a graph representing a relation between elapsed time and vehicle speed during each sag congestion.

When the driver sets, on the graph displayed on the display device 7, a tail zone, a central zone, and a restoration zone of the congestion area by means of the input device 6, the traveling information analysis unit 22 extracts, every $t_0$ seconds, traveling information of duration of T seconds from the traveling information for each zone, as period traveling information. The traveling information analysis unit 22 calculates, for each of the traveling information, basic statistics of vehicle speed data, such as average, standard deviation, kurtosis, skewness, average speed difference, standard error, dispersion, mode value, median value, maximum value, minimum value, and range. The traveling information analysis unit 22 then performs multivariate analysis on the period traveling information based on the basic statistics, particularly based on the average, standard deviation, kurtosis, skewness, and average speed difference of the vehicle speed.

Specifically, in order to integrate a plurality of statistics for use into two variables of variable Z1 and variable Z2 by means of multivariate analysis, the traveling information analysis unit 22 calculates, for each of the statistics, a coefficient for calculating the variable Z1 and the variable Z2 from each of the statistics. The variable Z1 and the variable Z2 can be obtained, for example, by discriminant functions represented by the following equations (1) and (2). In the equation (1), $a_{11}$, $a_{12}$, $a_{13}$, $a_{14}$, and $a_{15}$ denote coefficients for calculating the variable Z1. In the equation (2), $a_{21}$, $a_{22}$, $a_{23}$, $a_{24}$, and $a_{25}$ denote coefficients for calculating the variable Z2. C1 and C2 in the equations (1) and (2) denote constants for calculating the variable Z1 and the variable Z2, respectively.

$$Z1=a_{11}\times(\text{average})+a_{12}\times(\text{standard deviation})+a_{13}\times(\text{kurtosis})+a_{14}\times(\text{skewness})+a_{15}\times(\text{average speed difference})+C_1 \quad (1)$$

$$Z2=a_{21}\times(\text{average})+a_{22}\times(\text{standard deviation})+a_{23}\times(\text{kurtosis})+a_{24}\times(\text{skewness})+a_{25}\times(\text{average speed difference})+C_2 \quad (2)$$

The traveling information analysis unit 22 converts the period traveling information contained in the tail zone, the central zone, and the restoration zone into a coordinate space of the variables Z1 and Z2 based on this discriminant functions. The traveling information analysis unit 22 then calculates a discriminant straight line B1, a discriminant straight line B2, and a discriminant straight line B3 in the coordinate space of the variables Z1 and Z2. The discriminant straight line B1 is a boundary line between the tail zone and the central zone. The discriminant straight line B2 is a boundary line between the central zone and the restoration zone. The discriminant straight line B3 is a boundary line between the restoration zone and the tail zone.

Figure 4:
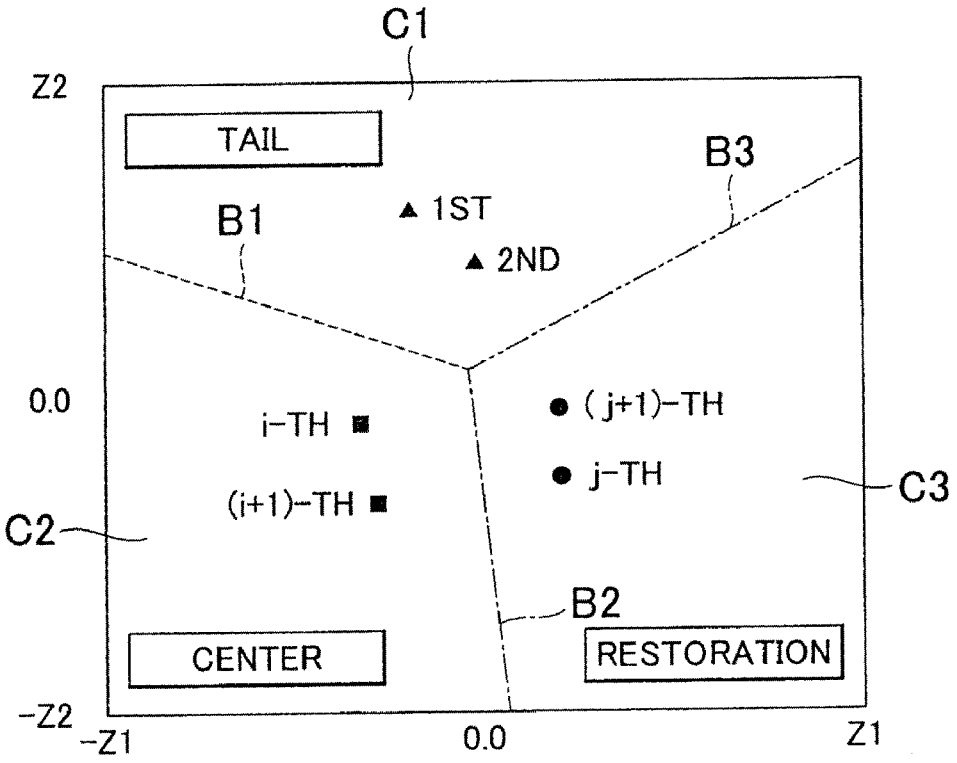
FIG. 4 is a graph illustrating traveling zones and discriminant straight lines analyzed by the traffic congestion detection apparatus according to the embodiment of the invention.

FIG. 4 is a diagram illustrating the discriminant straight lines defining the boundaries between the traveling zones. Region C1 is a region indicating the tail zone and defined by the discriminant straight line B3 and the discriminant straight line B1. Region C2 is a region indicating the central zone and defined by the discriminant straight line B1 and the discriminant straight line B2. Region C3 is a region indicating the restoration zone and defined by the discriminant straight line B2 and the discriminant straight line B3.

For example, coordinates obtained by converting the first and second period traveling information by the equations (1) and (2) as the discriminant functions belong to the region C1. Coordinates obtained by converting the i-th and (i+1)-th period traveling information by the equations (1) and (2) as the discriminant functions belong to the region C2. Coordinates obtained by converting the j-th and (j+1)-th period traveling information by the equations (1) and (2) as the discriminant functions belong to the region C3. In this manner, the traveling information analysis unit 22 sets the coefficients and constants in the equations (1) and (2) as the discriminant functions such that the period traveling information is classified in the coordinate space of the variables Z1 and Z2, according to the traveling zones set in the period traveling information.

The traveling zone determination unit 23 functions as traveling zone determination means for determining which of at least three zones in the congestion area the vehicle is traveling in, based on the current traveling information acquired by the traveling information acquisition unit 21 and an analysis result by the traveling information analysis unit 22. The traveling zone determination unit 23 determines that the host vehicle has entered the congestion area when the vehicle speed indicated by the vehicle speed information obtained by the traveling information acquisition unit 21 becomes a traffic congestion start threshold V1 or less, and determines that the vehicle is traveling in the tail zone of the congestion area.

Figure 5:
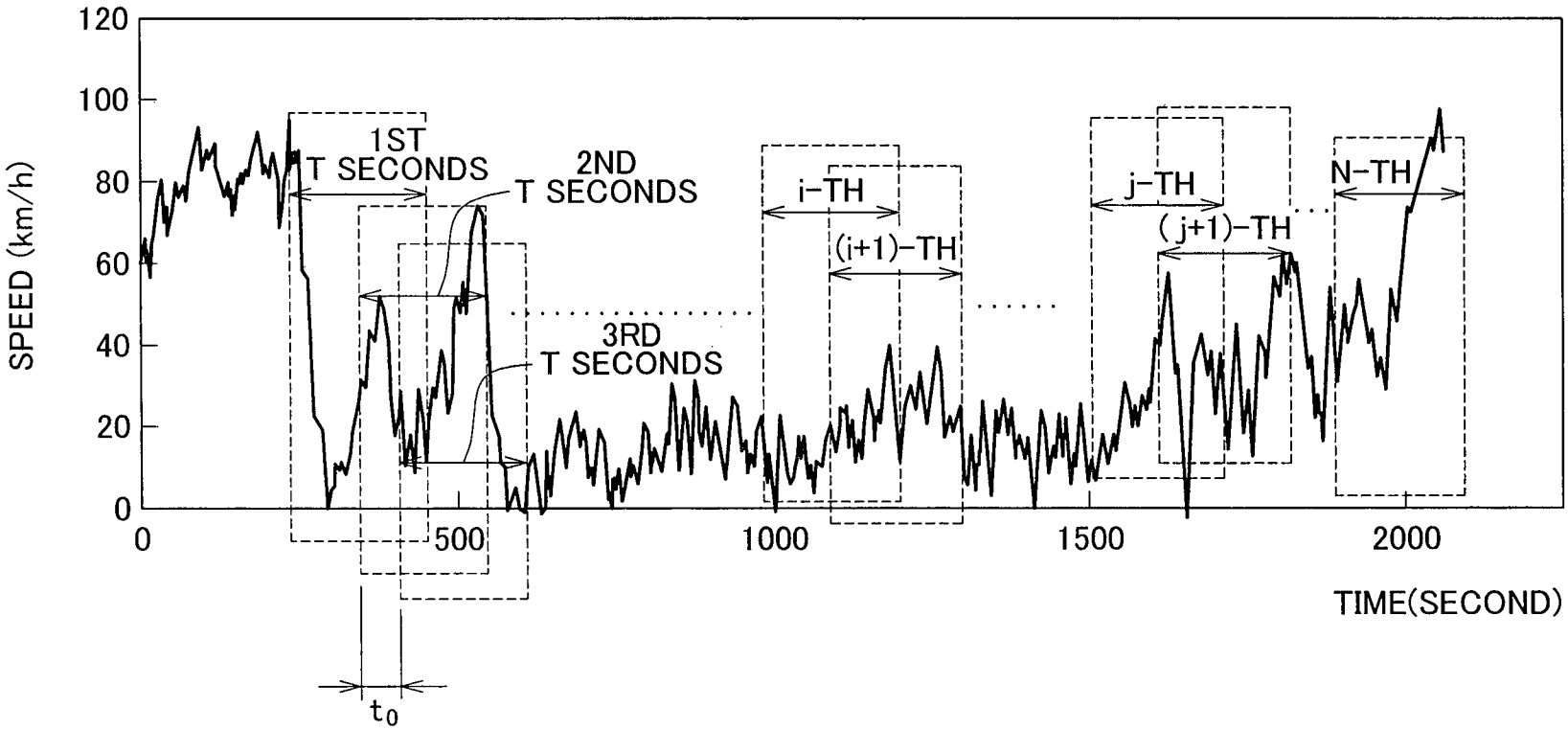
FIG. 5 is a diagram illustrating traveling information of the traffic congestion detection apparatus according to the embodiment of the invention.

Once the traveling zone determination unit 23 determines that the host vehicle is traveling in the congestion area, the traveling zone determination unit 23 extracts, every $t_0$ seconds, vehicle speed information of the host vehicle acquired by the traveling information acquisition unit 21 as period traveling information of duration of T seconds, as shown in FIG. 5. The traveling zone determination unit 23 then calculates an average vehicle speed, standard deviation, kurtosis, skewness, and average speed difference for each period traveling information, and calculates values of the variables Z1 and Z2 based on the calculated statistics and the discriminant functions calculated by the traveling information analysis unit 22. The traveling zone determination unit 23 determines which of the regions shown in FIG. 4 the coordinates indicated by the calculated values of the variables Z1 and Z2 belong to, and determines which one of the tail zone, the central zone, and the restoration zone in the congestion area the host vehicle is traveling in.

The driving assist unit 24 functions as driving assist means for assisting for assisting driving of the vehicle. The driving assist unit 24 assists the drive of the host vehicle according to the traveling zone determined by the traveling zone determination unit 23. A specific example of the driving assist will be described later. The traffic congestion detection apparatus 1 functions as a vehicle control apparatus when the ECU 2 has the driving assist unit 24.

Referring to the flowchart of FIG. 6, description will be made of procedures of the traveling zone determination processing by the traffic congestion detection apparatus 1 according to the embodiment.

The traveling zone determination unit 23 determines at predetermined intervals whether or not the vehicle speed indicated by the vehicle speed information obtained by the traveling information acquisition unit 21 has become the congestion start threshold V1 or less (S1). The traffic congestion start threshold V1 as used herein means a speed at which the vehicle can be determined to have entered the congestion area, and may be 40 km/h, for example. When the vehicle speed of the host vehicle is greater than the congestion start threshold V1 (No in S1), this determination processing is repeated at predetermined intervals. In contrast, when the vehicle speed of the host vehicle is equal to or less than the congestion start threshold V1 (Yes in S1), the traveling zone determination unit 23 determines that the host vehicle has entered the congestion area, and that the host vehicle is traveling in the tail zone of the congestion area (S2).

The traveling zone determination unit 23 then extracts, every $t_0$ seconds, the vehicle speed information of the host vehicle acquired by the traveling information acquisition unit 21 as period traveling information of duration of T seconds. The traveling zone determination unit 23 then calculates an average of vehicle speeds, standard deviation, kurtosis, skewness, and average speed difference for each period traveling information, and calculates values of the variables Z1 and Z2 based on the calculated statistics and the discriminant functions calculated by the traveling information analysis unit 22. The traveling zone determination unit 23 then determines whether or not the period traveling information belongs to the region C2 indicating the central zone based on the discriminant straight line B1 between the tail zone and the central zone and the discriminant straight line B2 between the central zone and the restoration zone calculated by the traveling information analysis unit 22 (S3). When it is determined that the period traveling information belongs to the region C2 indicating the central zone (Yes in S3), the traveling zone determination unit 23 determines that the host vehicle is traveling in the central zone of the congestion area (S4).

In contrast, when it is not determined that the period traveling information belongs to the region C2 indicating the central zone (No in S3), the traveling zone determination unit 23 determines whether or not the period traveling information belongs to the region C3 indicating the restoration zone based on the discriminant straight line B2 between the central zone and the restoration zone and the discriminant straight line B3 between the restoration zone and the tail zone calculated by the traveling information analysis unit 22 (S5). When it is determined that the period traveling information belongs to the region C3 indicating the restoration zone (Yes in S5), the traveling zone determination unit 23 determines that the host vehicle is traveling in the restoration zone of the congestion area (S6). In contrast, it is not determined that the period traveling information belongs to the region C3 indicating the restoration zone (No in S5), the traveling zone determination unit 23 determines that the host vehicle is traveling in the tail zone (S7).

The traveling zone determination unit 23 then determines whether or not the vehicle speed indicated by the vehicle speed information acquired by the traveling information acquisition unit 21 is equal to or less than a preset congestion end threshold V2 (S8). The congestion end threshold V2 as used herein means a speed at which the vehicle can be determined to have got out of the congestion area, and it may be 80 km/h, for example. When the vehicle speed of the host vehicle is equal to or less than the congestion end threshold V2 (Yes in S8), the processing returns to S3 to perform the traveling zone determination processing again. In contrast, when the vehicle speed of the host vehicle is greater than the congestion end threshold V2 (No in S8), the traveling zone determination unit 23 determines that the host vehicle has got out of the congestion area and is traveling freely (S9), and terminates the traveling zone determination processing.

The traveling zone determination unit 23 may be designed to determine which one of the region C1 indicating the tail zone, the region C2 indicating the central zone, and the region C3 indicating the restoration zone the period traveling information belongs to, instead of performing determination of whether or not the period traveling information belongs to the region C2 indicating the central zone (S3) and determination of whether or not the period traveling information belongs to the region C3 indicating the restoration zone (S5).

Specific examples of the driving assist by the traffic congestion detection apparatus 1 according to the embodiment will be described.

Figure 7:
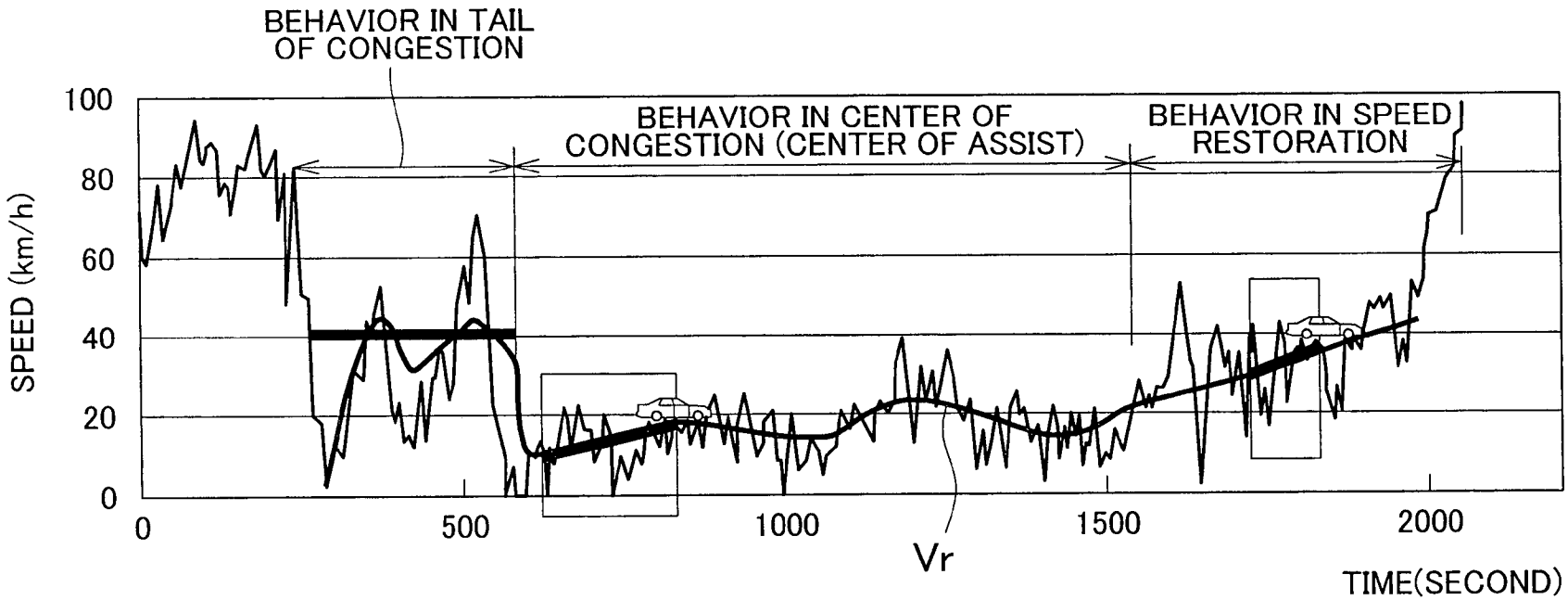
FIG. 7 is a diagram illustrating an example of driving assist by the traffic congestion detection apparatus according to the embodiment of the invention.

FIG. 7 is a diagram illustrating an example of driving assist by the traffic congestion detection apparatus 1. The driving assist unit 24 sets a recommended speed according to the zone which is determined by the traveling zone determination unit 23 to be the zone where the host vehicle is traveling. In the tail zone of the congestion area, the vehicle speed tends to fluctuate in low frequency and exhibit a large fluctuation range. Therefore, when the host vehicle is determined to be traveling in the tail zone, the driving assist unit 24 calculates an average speed in the tail zone based on previous traveling information stored in the traveling information storage 9, and sets the calculated average speed as the recommended speed in the tail zone.

In the central zone of the congestion area, the vehicle speed tends to exhibit stable fluctuation. Therefore, when the host vehicle is determined to be traveling in the central zone, the driving assist unit 24 calculates an average speed over a long period (e.g. 200 seconds) based on the vehicle speed indicated by the vehicle speed information acquired by the traveling information acquisition unit 21. The driving assist unit 24 sets the calculated average speed as the recommended speed in the central zone. In the restoration zone of the congestion area, the vehicle speed tends to exhibit variation of basically upward trend. Therefore, when the host vehicle is determined to be traveling in the restoration zone, the driving assist unit 24 calculates an average speed over a short period (e.g. 50 seconds) based on the vehicle speed indicated by the vehicle speed information acquired by the traveling information acquisition unit 21.

The driving assist unit 24 sets the calculated average speed as the recommended speed in the restoration zone. A curve Vr in FIG. 7 indicates the recommended speeds set in this manner. The driving assist unit 24 transmits acceleration/deceleration information to the engine ECU 11 and the brake ECU 12 so that acceleration/deceleration control is performed at speeds around the set recommended speed, for example. The driving assist unit 24 may be designed to display the set recommended speed on the display device 7 and to display an alarm when the vehicle speed of the host vehicle exceeds the recommended speed. The setting of the recommended speed according to the zone where the host vehicle is traveling makes it possible to guide the host vehicle to avoid useless acceleration. This reduces the fuel consumption of the host vehicle and ensures efficient traveling thereof.

The driving assist unit 24 may instruct the inter-vehicle control ECU 13 to control the inter-vehicle distance with the vehicle in front as spring-mass system motion. Describing more specifically, the driving assist unit 24 changes the spring constant k and damping coefficient C according to the standard deviation of the vehicle speed calculated by the traveling information analysis unit 22. The driving assist unit 24 transmits inter-vehicle control information containing the spring constant k and the damping coefficient C to the inter-vehicle control ECU 13. This makes it possible to perform inter-vehicle distance control with a state of traffic congestion taken into consideration.

Figure 8A:
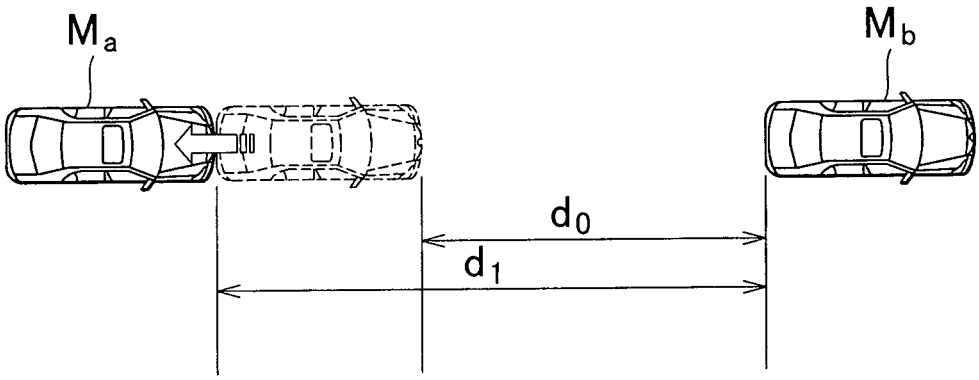
FIGS. 8A and 8B are diagrams illustrating, by way of example, inter-vehicle distances between the host vehicle and the vehicle in front according to the embodiment of the invention.

The driving assist unit 24 may instruct the inter-vehicle control ECU 13 to control the inter-vehicle distance according to the zone which is determined by the traveling zone determination unit 23 to be the zone where the host vehicle is traveling. FIG. 8A is a diagram illustrating an example of inter-vehicle distance between a host vehicle $M_a$ and a vehicle in front $M_b$ in the tail zone. As shown in FIG. 8A, an inter-vehicle distance $d_0$ is a target inter-vehicle distance to the vehicle in front $M_b$ when the host vehicle $M_a$ is traveling in normal mode (traveling outside the congestion area). The inter-vehicle distance $d_1$ is a target inter-vehicle distance to the vehicle in front $M_b$ when the host vehicle $M_a$ is traveling in the tail zone of the congestion area. The host vehicle $M_a$, which is determined to be traveling in the tail zone of the congestion area, will decelerate. Therefore, a greater inter-vehicle distance $d_1$ is allowed in the tail zone than the inter-vehicle distance $d_0$ during normal traveling. The driving assist unit 24 transmits inter-vehicle control information including this inter-vehicle distance $d_1$ to the inter-vehicle control ECU 13.

Figure 8B:
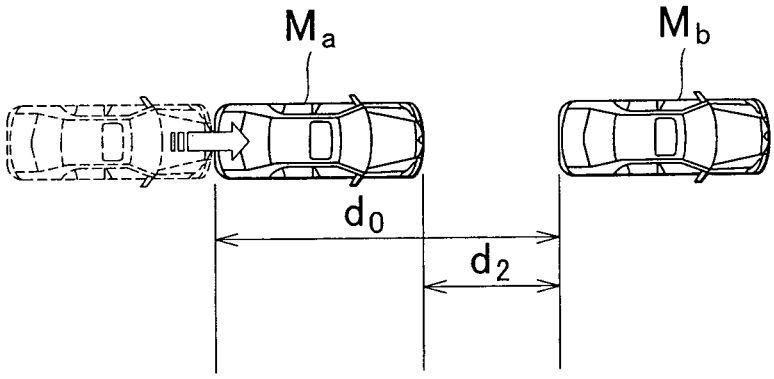

FIG. 8B is a diagram illustrating an example of inter-vehicle distance between the host vehicle $M_a$ and the vehicle in front $M_b$ in the restoration zone. As shown in FIG. 8B, an inter-vehicle distance $d_0$ is a target inter-vehicle distance to the vehicle in front $M_b$ when the host vehicle $M_a$ is traveling in normal mode, whereas an inter-vehicle distance $d_2$, is a target inter-vehicle distance to the vehicle in front $M_b$ when the host vehicle $M_a$ is traveling in the restoration zone of the congestion area. The host vehicle $M_a$, which is determined to be traveling in the restoration zone of the congestion area, will restore the speed (accelerate). Therefore, a smaller inter-vehicle distance $d_2$ is allowed in the restoration zone than the inter-vehicle distance $d_0$ during normal traveling. The driving assist unit 24 transmits inter-vehicle control information including this inter-vehicle distance $d_2$ to the inter-vehicle control ECU 13.

When the host vehicle $M_a$ is traveling in the central zone, the driving assist unit 24 calculates an average speed based on the vehicle speed indicated by the vehicle speed information acquired by the traveling information acquisition unit 21. The driving assist unit 24 may transmit acceleration/deceleration information to the engine ECU 11 and brake ECU 12, so that acceleration/deceleration is performed while a speed obtained by adding a predetermined additional value to the calculated average speed is set as an upper limit speed.

The traffic congestion detection apparatus according to the embodiment, as described above, analyzes a plurality items of traveling information and determines which one of the tail zone, the central zone and the restoration zone of the congestion area the vehicle is traveling in, based on the current traveling information and a result of the analysis, so that the apparatus is able to identify the zone of the congestion area where the vehicle is currently traveling. This makes it possible to perform control according to each traveling zone of the congestion area, for example, to perform driving assist suitable for the relevant traveling zone of the congestion area. As a result, reduction of fuel consumption of the vehicle can be achieved.

The traffic congestion detection apparatus and the vehicle control apparatus according to the invention are not limited to the embodiment described above.

For example, although in the embodiment the traveling information acquisition unit 21 receives vehicle speed information from the vehicle speed sensor 4 in the embodiment, the traveling information acquisition unit 21 may acquire traveling information such as vehicle speed information relating to the relevant region indicated by traffic congestion area information from another vehicle or an information center (server) or the like via the communication device 8. This configuration enables analysis based on even more items of traveling information and makes it possible to improve the accuracy of analysis. As a result, the accuracy of determining a traveling zone can be improved. When traveling information is acquired from another vehicle or an information center (server), the traveling zone determination unit 23 may be designed to determine which one of at least three zones of the congestion area the vehicle is traveling in.

Although, in the embodiment, the congestion area is classified into three traveling zones of a tail zone, a central zone, and a restoration zone, the invention is not limited to this, and the congestion area may be classified into a greater number traveling zones based on traveling states of the vehicle. While the traveling information analysis unit 22 classifies the congestion area into a plurality of traveling zones based on vehicle speed information, it may classify the congestion area into a plurality of traveling zones based on traveling information such as acceleration information. Further, the traveling information analysis unit 22 may classify the congestion area into a plurality of traveling zones based on a plurality of items of traveling information. While the traveling information analysis unit 22 classifies the congestion area into a plurality of traveling zones with the use of multivariate analysis, another analysis method may be used to classify the congestion area into a plurality of traveling zones.

While in the embodiment above, the driver sets the tail zone, the central zone, and the restoration zone of the congestion area for traveling information of N sag congestions, the traveling information analysis unit 22 may set the tail zone, the central zone, and the restoration zone according to variation in traveling state.

Preferably, the traveling information analysis unit 22 obtains a discriminant function for each region indicated by traffic congestion area information, and obtains a discriminant straight line for each region indicated by the traffic congestion area information. The traveling information analysis unit 22 may obtain a discriminant function for each time zone, and may obtain a discriminant straight line for each time zone. This makes it possible to improve the accuracy of determining the traveling zone even more.

The traveling zone determination unit 23 may be designed to determine which of at least three zones of the congestion area the vehicle is traveling in, based on a result of analysis by another vehicle (e.g. a discriminant function and a discriminant straight line), or a result of analysis by an information center (not shown) (e.g. a discriminant function and a discriminant straight line), instead of a result of the analysis by the traveling information analysis unit 22. The discriminant function and the discriminant straight line may be preliminarily set. In this case, the traffic congestion detection apparatus 1 need not have the traveling information analysis unit 22.

The traffic congestion detection apparatus 1 may further include other vehicle information acquisition unit (other vehicle information acquisition means) for acquiring traveling information on a traveling state of another vehicle, and other vehicle traveling zone determination unit (other vehicle traveling zone determination means) for determining whether or not the other vehicle is traveling in the congestion area. The other vehicle information acquisition unit calculates traveling information such as position, speed, and acceleration of another vehicle based on image information received from an on-vehicle camera (not shown), or distance information indicating a distance to another vehicle received from a radar (not shown). Alternatively, the other vehicle information acquisition unit may acquire other vehicle traveling information via the communication device 8.

Figure 6:
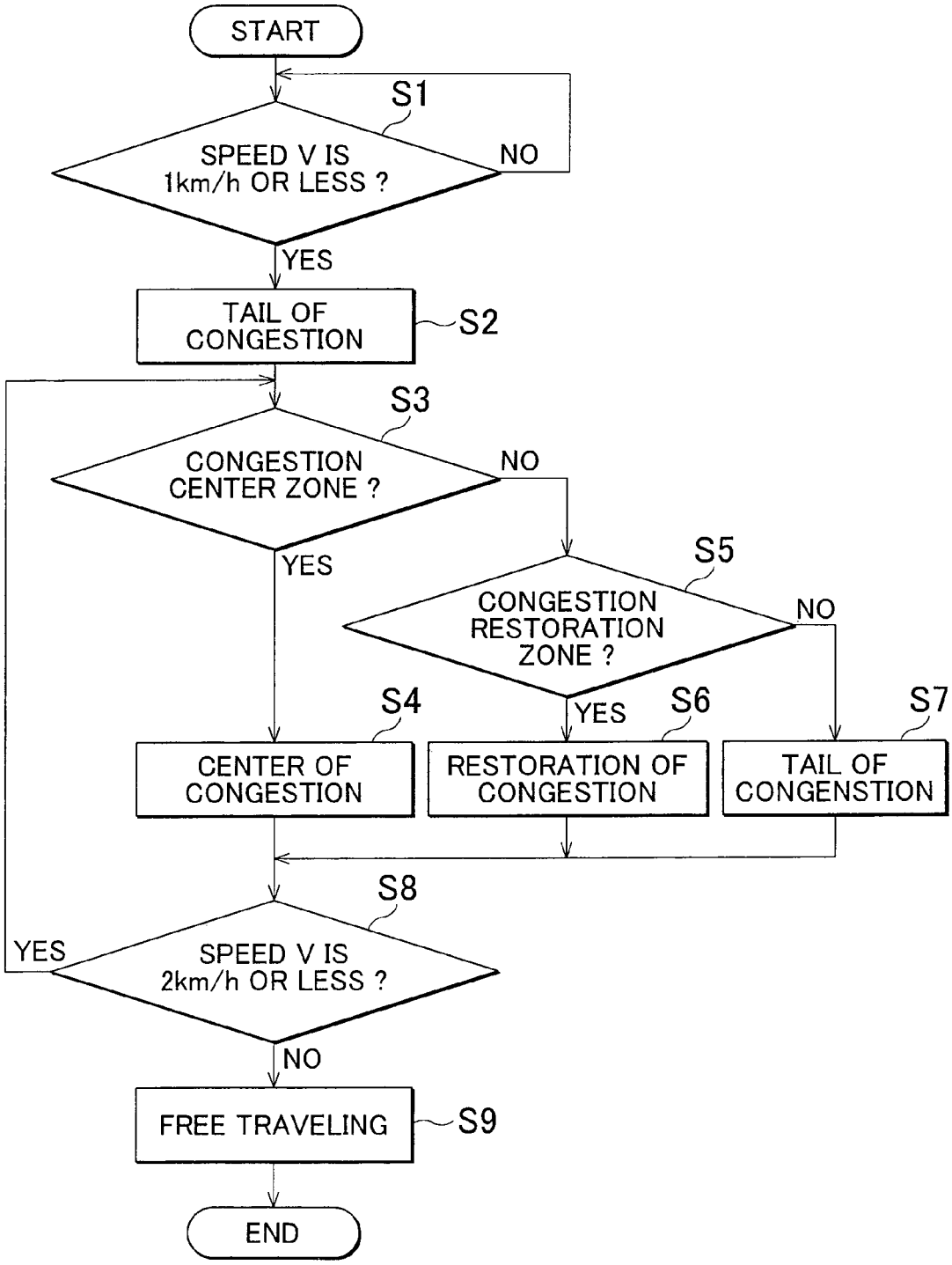
FIG. 6 is a flowchart for explaining traveling zone determination processing by the traffic congestion detection apparatus according to the embodiment of the invention.

Like the traveling zone determination unit 23, the other vehicle traveling zone determination unit uses the flowchart of FIG. 6 to determine whether or not the vehicle speed of another vehicle has become equal to or less than the congestion start threshold V1, and thereby determines whether or not the other vehicle is traveling in the congestion area. The other vehicle traveling zone determination unit also determines whether or not the vehicle speed of the other vehicle has become equal to or less than the congestion end threshold V2 to thereby determine whether or not the other vehicle has got out of the congestion area.

The driving assist unit 24 may perform driving assist based on a result of the determination by the other vehicle traveling zone determination unit. Describing more specifically, when the other vehicle traveling zone determination unit determines that another vehicle is traveling in the congestion area, a threshold of inter-vehicle distance between the host vehicle and the other vehicle, that is used for determining whether or not deceleration assist is to be performed, is set to a smaller value than when the other vehicle is traveling in normal mode. Thus, the driving assist can be performed even more adequately by changing the driving assist for the host vehicle according to whether or not the other vehicle is driving in the congestion area.

Although in the embodiment above, the traffic congestion detection apparatus 1 is mounted on the host vehicle, the invention is not limited to this. For example, the traffic congestion detection apparatus 1 may be provided in an information center (not shown). In this case, the information center may be designed to acquire traveling information from vehicles and to calculate a discriminant function and a discriminant straight line by analyzing the plurality of items of traveling information thus acquired. The information center then may determine which one of the tail zone, the central zone, and the restoration zone of the congestion area the vehicles are traveling in, based on the discriminant functions and the discriminant straight lines. The information center thus is capable of calculating the discriminant function and the discriminant straight line by analyzing traveling information of a plurality of vehicles. This makes it possible to perform the analysis with even higher accuracy. In addition, the a traveling zone of the congestion area where each vehicle is traveling in can be determined, even if the vehicle has no traffic congestion detection apparatus 1.

The invention claimed is:

1. A vehicle control apparatus, comprising:

a traffic congestion detection apparatus mounted on a vehicle and which comprises:

a traveling information acquisition unit which acquires traveling information relating to a traveling state of the vehicle;

a traveling zone determination unit which determines which one of a tail zone, a central zone, and a restoration zone of a congestion area the vehicle is traveling in, based on current traveling information acquired by the traveling information acquisition unit;

a traveling information analysis unit which performs multivariate analysis on a plurality of items of travel information acquired by the traveling information acquisition unit, calculating at least two variables at different times based on an average, a standard deviation, kurtosis, skewness, and average speed difference of the vehicle speed obtained at the different times, and determining a region to which the calculated variables belong, as a zone in which the vehicle is traveling, the region is one of plural regions which correspond to the tail zone, the central zone, and the restoration zone; and a driving assist unit which assists driving of the vehicle based on a result of the determination by the traveling zone determination unit, wherein the tail zone is a zone where the vehicle exhibits a tendency to decelerate, and corresponds to a zone where the vehicle has just entered the congestion area, and the central zone is a zone where the vehicle exhibits stable speed variation, and corresponds to a central zone of the congestion area, and the restoration zone is a zone where the vehicle exhibits a tendency to accelerate, and corresponds to a zone where the vehicle is about to get out of the congestion area.

2. The vehicle control apparatus according to claim 1, wherein:

the traveling information acquisition unit acquires the traveling information relating to a plurality of vehicles; and the traveling zone determination unit determines which zone of the congestion area each of the plurality of vehicles is traveling in, based on the traveling information relating to the plurality of vehicles acquired by the traveling information acquisition unit.

3. The vehicle control apparatus according to claim 1, wherein the traveling information analysis unit analyzes a plurality of items of traveling information acquired by the traveling information acquisition unit, and sets the tail zone, the central zone and the restoration zone according to a change in the traveling state.

4. The vehicle control apparatus according to claim 1, further comprising an input device that performs setting for the traffic congestion detection apparatus, wherein the tail zone, the central zone and the restoration zone are set by the input device.

5. The vehicle control apparatus according to claim 1, further comprising:

another vehicle information acquisition unit acquires traveling information relating to a traveling state of another vehicle; and another vehicle traveling zone determination unit acquires whether or not the other vehicle is traveling in the congestion area based on the traveling information of the other vehicle acquired by the other vehicle information acquisition unit, and a result of the analysis by the traveling information analysis unit, wherein the driving assist unit assists driving of the vehicle based on a result of the determination by the other vehicle traveling zone determination unit.

6. The vehicle control apparatus according to claim 5, wherein the traveling information analysis unit analyzes a plurality of items of traveling information acquired by the traveling information acquisition unit, and sets the tail zone, the central zone and the restoration zone according to a change in the traveling state.

7. The vehicle control apparatus according to claim 5, further comprising an input device which performs setting for the traffic congestion detection apparatus, wherein the tail zone, the central zone and the restoration zone are set by the input device.

8. The vehicle control apparatus according to claim 5, wherein the driving assist unit sets a recommended speed for each of the tail zone, the central zone and the restoration zone, and performs acceleration/deceleration control in a predetermined range the center speed of which is set to the recommended speed.

9. The vehicle control apparatus according to claim 1, wherein:

when the vehicle is traveling in the tail zone, the driving assist unit sets a target inter-vehicle distance to be greater than a target inter-vehicle distance during normal traveling of the vehicle that is traveling outside of the congestion area; and when the vehicle is traveling in the restoration zone, the driving assist unit sets a target inter-vehicle distance to be smaller than a target inter-vehicle distance during normal traveling of the vehicle that is traveling outside of the congestion area.

10. A vehicle control apparatus, comprising:

a traffic congestion detection apparatus mounted on a vehicle and which comprises circuitry configured to:

acquire traveling information relating to a traveling state of the vehicle;

determine which one of a tail zone, a central zone, and a restoration zone of a congestion area the vehicle is traveling in, based on current traveling information acquired;

perform multivariate analysis on a plurality of items of travel information acquired, calculating at least two variables at different times based on an average, a standard deviation, kurtosis, skewness, and average speed difference of the vehicle speed obtained at the different times, and determining a region to which the calculated variables belong, as a zone in which the vehicle is traveling, the region is one of plural regions which correspond to the tail zone, the central zone, and the restoration zone; and assist driving of the vehicle based on a result of the determination by the circuitry, wherein the tail zone is a zone where the vehicle exhibits a tendency to decelerate, and corresponds to a zone where the vehicle has just entered the congestion area, and the central zone is a zone where the vehicle exhibits stable speed variation, and corresponds to a central zone of the congestion area, and the restoration zone is a zone where the vehicle exhibits a tendency to accelerate, and corresponds to a zone where the vehicle is about to get out of the congestion area.

* * * * *